United States Patent [19]

Burgers et al.

[11] Patent Number: 4,648,344

[45] Date of Patent: Mar. 10, 1987

[54] BOAT HULL CLEANING DEVICE

[76] Inventors: John Burgers, P.O. Box 2101; Ronald P. Setzer, P.O. Box 5224, both of Santa Cruz, Calif. 95063

[21] Appl. No.: 752,486

[22] Filed: Jul. 5, 1985

Related U.S. Application Data

[63] Continuation of Ser. No. 557,544, Dec. 2, 1983, abandoned.

[51] Int. Cl.[4] ..... B63B 59/08

[52] U.S. Cl. ..... 114/222; 15/244 R

[58] Field of Search ..... 114/222; 15/244 R

[56] References Cited

U.S. PATENT DOCUMENTS

| | | | |
|---|---|---|---|
| 630,260 | 8/1899 | McLane | 114/222 |
| 832,161 | 10/1906 | Rogers | 114/222 |
| 834,399 | 10/1906 | McLellan et al. | 114/222 |
| 3,010,420 | 11/1961 | Glynn | 114/222 |
| 4,395,966 | 8/1983 | Murphy | 114/222 |
| 4,407,213 | 10/1983 | Evans | 114/222 |

FOREIGN PATENT DOCUMENTS

| | | | |
|---|---|---|---|
| 2465568 | 3/1981 | France | 114/222 |

*Primary Examiner*—Galen L. Barefoot
*Assistant Examiner*—Thomas J. Brahan
*Attorney, Agent, or Firm*—Allston L. Jones

[57] ABSTRACT

A device for scrubbing marine growth from the submerged portion of a boat hull; said device being particularly concerned with manual operation by one person from deck or dockside and comprising an operator's guidance handle attatched to a flexible arm to which is fastened on its underside, surface-seeking-flotation and to its upper surface, scrubbing material which when moved about on the submerged portions of a boat's hull scrubs therefrom unwanted marine growth.

9 Claims, 2 Drawing Figures

BOAT HULL CLEANING DEVICE

The flexible arm, in a disclosed embodiment, is an elongated narrow sheet of thin stainless steel, and has the relative flexibility and stiffness thereof.

CROSS REFERENCE TO RELATED APPLICATION

This is a continuation of application Ser. No. 557,544, filed Dec. 2, 1983, now abandoned.

BACKGROUND OF THE INVENTION

The importance of keeping the submerged portions of a boat's hull free of marine growth lies in the fact that the growth causes hull drag which results in slowing the boat's passage through water.

At the present time there are in general practice two methods for removing unwanted marine growth from the submerged portions of boat hulls. The first is to remove the boat from the water by means of a hoist, trailer or by beaching. The subject invention does not concern boats which have been moved to dry land and this commom method of attaining access to a boat's hull for cleaning is mentioned only because it is illustrative of a prior art technique which is inconvenient, time consuming and in the case of using a marine hoist, costly.

The second commonly employed method is for a diver to swim beneath the boat and clean the hull by means of a hand held brush or other abrasive material. This method when employing professional divers can be costly and in any event is time consuming. This method is mentioned here because it is the function of the improved subject invention to perform the same scrubbing action without the necessity of having a diver enter the water.

SUMMARY OF THE INVENTION

This invention is intended to give boat owners a means of reaching under their boat's hull from dockside while the boat is in the water for the purpose of scrubbing away unwanted marine growth.

Another object of the invention is to provide small craft owners with a scrubbing device which will through the means of an elongated flexible arm give the operator a way to apply scrubbing action to the varying contours of boat hulls.

It is a further object of the invention to apply upward pressure to the above-mentioned flexible arm by means of surface-seeking flotation which when secured under the flexible arm and submerged will apply pressure along an extended portion of the arm and thereby force it to conformity with the varying curves and angles of a boat's hull.

An additional object of the invention is to cause this same flotation which is acting on the flexible arm and forcing it upward, to apply like pressure against scrubbing material which is fastened to the upper surface of the flexible arm in order that the three entities (flotation, flexible arm, scrubbing material) will in concern when drawn back and forth over the boat's hull, remove unwanted marine growth therefrom.

It is a further object of the invention to have a handle which is detachable from the above described flexible arm which will enable the operator to guide the entire means under and thence along the submerged hull while standing on the dock immediately adjacent to the boat.

It is a further object of the invention to employ in its manufacture materials already fabricated for other common usages thereby eliminating the need for costly special molds, stamping or extrusions. Working models using the following materials have proven to be highly effective in attaining the desired boat bottom scrubbing results sought for:

Flexible arm: A band of stainless steel 1/32 of an inch thick, six inches wide and four feet long.

Scrubbing material: Scouring material commonly used in cleaning household pots and pans. This material is fastened in a continuous six inch strip along the upper side of the flexible arm.

Flotation: Six inch sections of two inch PVC tubing sealed at both ends with plastic plugs.

Handle: A four foot length of one inch aluminum tubing which is fastened to the flexible arm by two wing nuts. The handle can be removed readily from the flexible arm in order to ensure easy storage.

Recounting here of the materials and their dimensions does not intend to limit any variations on the above which may either decrease construction costs or improve the efficiency of the entire device.

BRIEF DESCRIPTION OF THE DRAWINGS

Other objects and advantages of the invention will become more apparent from the specifications taken in conjunction with the accompanying drawings in which.

DETAILED DESCRIPTION OF THE DRAWINGS

Figure 1:
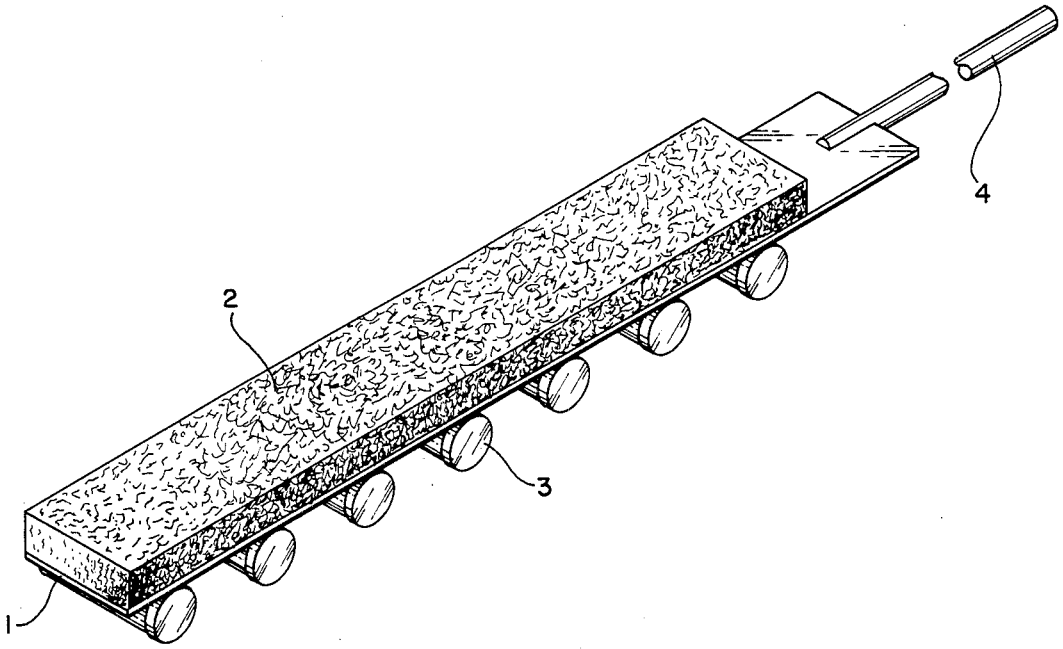
FIG. 1 is a perspective view of the entire device in accordance with the preferred embodiment of the invention.

FIG. 1 illustrates the entire device with the flexible arm 1 thereof having fastened to its upper surface scrubbing material 2 and to its lower surface flotation 3 and with the handle 4 attached to the entire scrubbing means 1, 2, 3.

As indicated hereinabove, and as seen in FIG. 1, the flexible arm 1 is elongated in length and of relatively narrow width. Further, the same is thin, as 1/32" in the case of stainless steel, thereby to have the required flexibility to substantially conform to a generally curved hull as well as a modicum of stiffness or rigidity therein as in the case of a steel sheet, thereby permitting guiding of the flexible arm or sheet 1 along the hull as set forth above.

Figure 2:
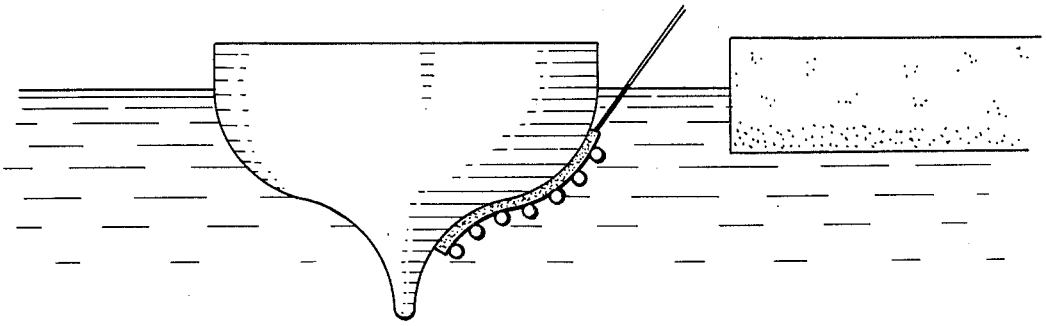
FIG. 2 diagramatically illustrates the device submerged at dockside an in position for scrubbing.

FIG. 2 illustrates the entire scrubbing means of FIG. 1, including sheet 1, scrub material 2, and spaced floats 3 with the handle extending therefrom for ready manual manipulation by a single operator from an adjacent dock to submerge the device alongside a boat hull, and indicating the flexure of the sheet by the several floats to place the scrub material in proximity to a generally curved boat hull while permitting the one-man reciprocating scrubbing action by the handle attached at only one end of the sheet.

I claim:

1. A one-man manually operable device for cleaning marine growth from submerged portions of a boat hull, comprising, an elongated sheet of relatively thin material having a substantial length to width ratio, and having opposite surfaces thereon and opposite proximate and distal ends along the length thereof, wherein said strip is of a length to extend a substantial distance downwardly along the side of a boat hull from a point at the upper edge thereof, one said sheet surface having scrubbing material affixed thereto over substantially the entirety thereof between said sheet ends, the opposite said sheet surface having a plurality of discrete floats affixed thereto at spaced points along the length thereof between the sheet ends, handle means for manipulation and underwater extension of said sheet and said distal end thereof, said handle means being a single elongated operator's handle affixed only to and extending from one proximate sheet end, with said distal end being free of any operating handle means thereon, said sheet having sufficient rigidity in a direction along its length so as to permit ready manual manipulation by said single handle of said sheet in the water proximate to a boat hull to position the said distal sheet end at a furthermost distance of said sheet from said handle at a desired location with respect to said hull notwithstanding inherent forces on said sheet to fold and buckle the sheet by buoyancy of said floats as said sheet is manually inserted and immersed downwardly in water, and, said sheet having sufficient flexibility to permit limited bending thereof in a direction parallel to the sheet width in response to buoyant float forces thereon when submerged, thereby to permit said sheet to substantially accommodate curvature of the boat hull, whereby when said sheet is submerged into water adjacent a boat hull with said one sheet surface scrubbing material proximate the boat hull, said handle and said sheet rigidity permitting desired positioning of said sheet and distal sheet end for cleaning a hull area, and said floats effect limited flexing thereof under buoyant pressure so as to substantially conform said sheet along its length to curvature of said boat hull thereby to place said scrubbing material in contact with said hull, whereby manual manipulation of said handle to reciprocate said sheet in a direction along its length will effect cleaning of said hull.

2. The device of claim 1 wherein said sheet is thin stainless steel.

3. The device of claim 2 wherein said sheet is on the order of four feet in length, six inches in width, and 1/32 inch in thickness.

4. A device as in claim 1 wherein the combined length of the sheet and the handle in sufficiently long to reach at least to the keel of the boat from above the surface of the water.

5. A device as in claim 1 wherein said flotation means includes a plurality of spaced-apart means each having a gas captured therein for providing buoyant force to the thin sheet.

6. A device as in claim 5 wherein each of said flotation means is a sealed tubular section of non-corrosive material containing air therein.

7. A device as in claim 1 wherein said handle is of sufficient length to permit extension of the thin sheet to the keel of the boat from above the surface of the water.

8. A device as in claim 1 wherein said handle is removable from the thin sheet to facilitate storage of the device.

9. A device as in claim 1 wherein the material of the thin sheet is such that the dimensions of the surfaces thereof remain substantially unchanged in tension and compression created by manually applied forces.

* * * * *